US009611666B1

(12) United States Patent
Neighbor

(10) Patent No.: US 9,611,666 B1
(45) Date of Patent: Apr. 4, 2017

(54) UTILITY POLE REPAIR PLATE SYSTEMS AND METHODS

(71) Applicant: OSMOSE UTILITIES SERVICES, INC., Peachtree City, GA (US)

(72) Inventor: Kristopher Mark Neighbor, Peachtree City, GA (US)

(73) Assignee: Osmose Utilities Services, Inc., Peachtree City, GA (US)

( * ) Notice: Subject to any disclaimer, the term of this patent is extended or adjusted under 35 U.S.C. 154(b) by 0 days.

(21) Appl. No.: 15/059,969

(22) Filed: Mar. 3, 2016

(51) Int. Cl.
*E04H 12/00* (2006.01)
*E04G 23/02* (2006.01)

(52) U.S. Cl.
CPC ..... *E04G 23/02* (2013.01); *E04H 12/00* (2013.01)

(58) Field of Classification Search
CPC . E04H 12/2223; E04H 12/2292; E04H 17/22; E04H 17/20; E04H 12/00; E04G 23/02; E02D 5/801
USPC ..... 52/514, 514.5, 170, 834, 835, 843; 405/211, 216
See application file for complete search history.

(56) References Cited

U.S. PATENT DOCUMENTS 1,784,770 A * 12/1930 Wiley ..... E04H 12/2292 52/170
2,707,034 A * 4/1955 Hetrick ..... E04H 12/00 174/42
3,077,704 A * 2/1963 Osterberg ..... E02D 27/42 52/170
3,771,820 A * 11/1973 Hoss, Sr. ..... F16L 13/103 285/373
4,439,070 A * 3/1984 Dimmick ..... E02D 5/64 24/271
5,573,354 A * 11/1996 Koch ..... E02D 5/60 405/216
6,233,898 B1 * 5/2001 Burlando ..... G09F 13/14 116/63 P
6,286,281 B1 * 9/2001 Johnson ..... B29C 70/525 52/309.9
6,773,206 B2 * 8/2004 Bradley ..... E02B 17/0026 405/211
7,168,220 B2 * 1/2007 Owoc ..... B29C 63/18 52/844
7,997,044 B2 * 8/2011 Green ..... A47B 96/202 220/6
8,959,871 B2 * 2/2015 Parenti ..... E04C 3/36 52/170
9,010,069 B2 * 4/2015 Bernard ..... E04H 12/2292 52/844
9,032,694 B2 * 5/2015 Bernard ..... E04H 12/2292 52/844
9,359,785 B2 * 6/2016 Catt ..... A01G 17/14
2002/0094239 A1 * 7/2002 Bradley ..... E02B 17/0026 405/216

(Continued)

*Primary Examiner* — Beth Stephan
(74) *Attorney, Agent, or Firm* — Troutman Sanders, LLP; James E. Schutz; Andrew C. Doherty

(57) ABSTRACT

The disclosed technology includes utility pole repair plates for repairing a pole, such as a utility pole. One or more utility pole repair plates may be attached to a utility pole in an interconnected fashion to cover a portion or the entire circumference of a utility pole. A utility pole repair plate may include multiple substantially planar interconnected plate segments disposed at angles designed to accommodate a particular pole geometry.

19 Claims, 14 Drawing Sheets

(56) References Cited

U.S. PATENT DOCUMENTS

| | | | | |
|---|---|---|---|---|
| 2005/0097855 | A1* | 5/2005 | Fouad | E04H 12/12 52/843 |
| 2005/0271467 | A1* | 12/2005 | Ong | E02D 5/08 403/359.1 |
| 2006/0185270 | A1* | 8/2006 | Handley | E04C 3/30 52/169.14 |
| 2009/0266026 | A1* | 10/2009 | Hannay | E04H 12/2292 52/745.17 |
| 2010/0236182 | A1* | 9/2010 | Mackenzie | E04C 3/30 52/588.1 |
| 2015/0082742 | A1* | 3/2015 | Catt | A01G 17/14 52/835 |

* cited by examiner

UTILITY POLE REPAIR PLATE SYSTEMS AND METHODS

BACKGROUND

There are over one hundred million utility poles in the U.S. These utility poles are an integral piece of the infrastructure of the country as they provide support for electric wires, cable, and communications wires. However, many of these poles are decades old and have degraded over time, requiring varying degrees of maintenance and repair. For example, steel utility poles may become damaged due to corrosion and may develop holes or other weaknesses that can undermine the structural integrity of the pole. Other types of poles, such as, for example, mono-pole cell-towers and light poles, can experience similar degradation. It is both a time-consuming and expensive process to replace a damaged utility pole, and as such, it is generally desirable to repair a damaged utility pole if possible.

However, patching a hole in a steel utility pole is also a time-consuming process as it typically requires a customized solution, as the size, shape, taper, location, and nature of the corroded portion of a pole will vary from case to case. Additionally, utility poles come in many shapes and sizes. For example, utility poles can be circular, 4-sided, 6-sided, 8-sided, 12-sided, 16-sided, or other suitable configuration. Another complicating factor is that the pole manufacturing process is not always perfect, and so it may be necessary to measure the individual pole before developing a repair solution. Thus, in order to develop a customized pole repair solution, an engineering team may be required to first spend considerable time studying and understanding the geometry of the pole and the geometry of the damaged area. Thus, there is a need for a standardized system and method of repairing a steel utility pole.

SUMMARY

Some or all of the above deficiencies may be addressed by certain embodiments of the disclosed technology. One or more utility pole repair plates may be used to repair, strengthen, harden, or uprate a utility pole without the need for engineering a customized solution for that particular pole. Utility pole repair plates may have a variety of standardized designs, which each standardized design corresponding to a particular utility pole geometry. For example, utility pole repair plates may be designed for use on multi-sided poles including, but not limited to, an 8-sided utility pole, a 12-sided utility pole, or a 16-sided utility pole. Thus, a repair technician may be enabled to quickly respond to a call to repair a utility pole on any geometry by carrying a supply of utility pole repair plates corresponding to each utility pole geometry. Due to the interconnecting design of the utility pole repair plates, the utility pole repair plates may be used to repair, strengthen, harden, or uprate a portion of a utility pole or the entire circumference by selecting the number of utility pole repair plates necessary for the situation.

According to an example embodiment, a pole repair plate is provided. The pole repair plate may have a top edge, a bottom edge, a first side edge and a second side edge. The pole repair plate may include a first substantially planar plate segment including the first side edge of the repair plate. The pole repair plate may further include a second substantially planar plate segment connected to the first substantially planar plate segment at a shoulder, the first substantially planar plate segment disposed at a first angle from the second substantially planar plate segment. The pole repair plate may further include a third substantially planer plate segment connected to the second substantially planar plate segment at a second angle. The pole repair plate may further include a fourth substantially planar plate segment connected to the third substantially planar plate segment, the fourth substantially planar plate segment including the second side edge of the repair plate, the fourth substantially planar plate segment disposed in a substantially parallel direction to the second planer plate segment and offset from the second substantially planar plate segment by an offset distance.

According to an example embodiment, a method of repairing a pole is provided. The method may include placing a first repair plate substantially flush against a pole, the first repair plate including: a first substantially planar plate segment, a second substantially planar plate segment connected to the first substantially planar plate segment at a shoulder, the first substantially planar plate segment disposed at a first angle from the second substantially planar plate segment, and a fourth substantially planar plate segment connected to the third substantially planar plate segment, the fourth substantially planar plate segment including the second side edge of the repair plate, the fourth substantially planar plate segment disposed in a substantially parallel direction to the second planer plate segment and offset from the second substantially planar plate segment by an offset distance. According to some embodiments, the first substantially planar plate segment may be positioned flush against a first side of the pole, and the second substantially planar plate segment may be positioned flush against a second side of the pole, wherein the second side of the pole is adjacent to the first side of the pole. The method may further include placing a second repair plate substantially flush against the pole, wherein the second repair plate is placed adjacent to the first repair plate, such that: a first substantially planar plate segment of the second repair plate may be positioned flush against the second side of the pole, a second substantially planar plate segment of the second repair plate may be positioned flush against a third side of the pole, wherein the third side of the pole may be adjacent to the second side of the pole, and the end of the first substantially planar plate segment of the second repair plate may be received by the gap formed between the fourth substantially planar plate segment of the first repair plate and the surface of the second side of the pole. The method may further include affixing the first substantially planar plate segment of the second repair plate to the fourth substantially planar plate segment of the first repair plate. The method may further include affixing the first and second substantially planar plate segments of the first repair plate to the first and second sides of the pole, respectively. Finally, the method may further include affixing the first and second substantially planar plate segments of the second repair plate to the second and third sides of the pole, respectively.

According to another example embodiment, a pole repair plate is provided. The pole repair plate may have a top edge, a bottom edge, a first side edge and a second side edge. The pole repair plate may include a first substantially planar plate segment including the first side edge of the repair plate. The pole repair plate may further include a second substantially planar plate segment rotatably connected to the first substantially planar plate segment by a hinge, the first substantially planar plate segment disposed at a first angle from the second substantially planar plate segment, the first angle being adjustable based on the rotation of the hinge. The pole repair plate may further include a third substantially planer plate segment connected to the second substantially planar plate segment at a second angle. Finally, the pole repair plate may include a fourth substantially planar plate segment connected to the third substantially planar plate segment, the fourth substantially planar plate segment including the second side edge of the repair plate, the fourth substantially planar plate segment disposed in a substantially parallel direction to the second planer plate segment and offset from the second substantially planar plate segment by an offset distance.

Other embodiments, features, and aspects of the disclosed technology are described in detail herein and are considered a part of the claimed disclosed technology. Other embodiments, features, and aspects can be understood with reference to the following detailed description, accompanying drawings, and claims.

BRIEF DESCRIPTION OF THE FIGURES

Reference will now be made to the accompanying figures and flow diagrams, which are not necessarily drawn to scale, and wherein.

DETAILED DESCRIPTION

Figure 1:
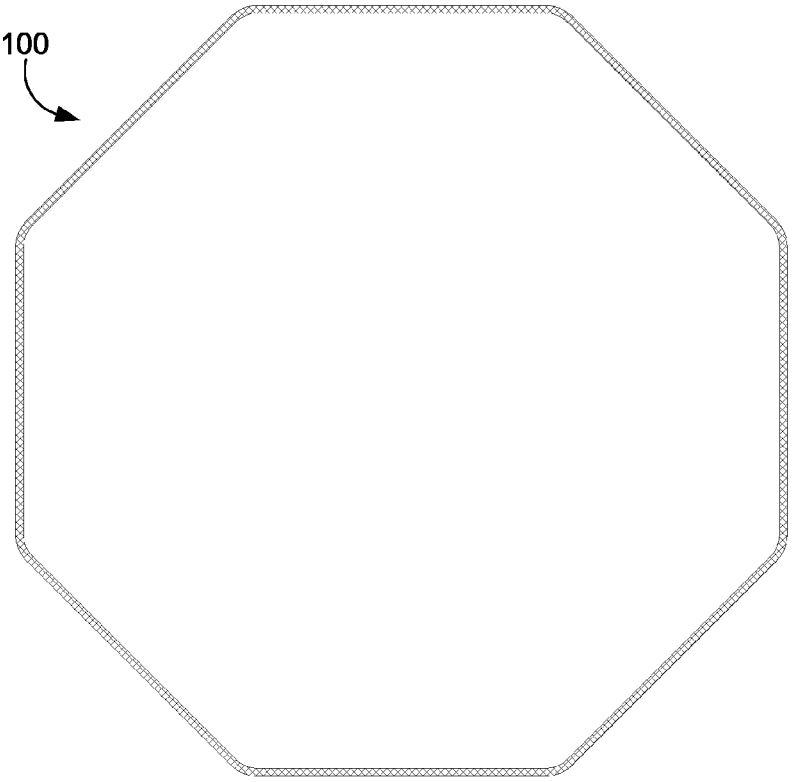
FIG. 1 is a cross-sectional top view of an 8-sided utility pole, according to an example implementation.

Embodiments of the disclosed technology include utility pole repair plate apparatuses and methods that can be used to repair a utility pole and, in particular, a steel or metal utility pole. Further, although this disclosure is generally directed towards describing the repair or strengthening of utility poles, it should be understood that the utility pole repair plates described herein may be used to repair a wide variety of other types of poles, including, for example, mono-pole cell-towers and light poles. One or more utility pole repair plates of the current disclosure may be deployed to quickly repair, strengthen, harden, or uprate a utility pole without the need for engineering a customized solution for that particular pole. By providing a standardized, interconnecting design, the utility pole repair plates of the current disclosure may fit a multitude of different repair locations on both tapered and non-tapered utility poles and accommodate variations across poles. According to some embodiments, the utility pole repair plates can be used to repair, strengthen, harden, or uprate the entire circumference of the utility pole. In some embodiments, the utility pole repair plates may be used to repair, strengthen, harden, or uprate a partial circumference of a utility pole.

According to certain embodiments a utility pole repair plate may include two substantially planer plate segments connected together that may be designed to be attached to two adjacent sides of a utility pole. In some embodiments, a utility pole repair plate may further include two more substantially planar plate segments designed to attach to an adjacent repair place. The angles formed between the various plate segments in the utility pole repair plate may be designed to fit a particular shape of pole, for example, a 4-sided, 6-sided, 8-sided pole, 12-sided pole, or a 16-sided pole. One advantage of the utility pole repair plate is that for a given pole design (e.g., an 8-sided pole), the utility pole repair plate may be used to fit on a wide variety of different repair locations on the pole, which may include tapered regions of the pole, thus creating a "one size fits all" type of repair solution for a pole with a given number of sides. For poles that do not have a regular shape (i.e., not all sides and angles are equal), different repair plates may be used in combination to repair the pole.

Throughout this disclosure, certain embodiments are described in exemplary fashion in relation to a utility pole repair plate designed to repair a damaged 8-sided utility pole. However, embodiments of the disclosed technology are not so limited. In some embodiments, the disclosed apparatuses and methods may be effective in repairing poles of different geometries (e.g., a 4, 6, 12, or 16-sided utility pole) or for strengthening undamaged utility poles. Furthermore, the figures provide examples of standard configurations of utility poles, but it will be appreciated by those of skill in the art that the utility pole repair plates disclosed herein may be modified or adapted for use with other multi-faceted poles, regardless of the quantity of facets that comprise the respective cross-section. Furthermore, variations in pole designs, such as for example, faceted oval shaped poles, may also be accommodated by variations to the utility pole repair plates disclosed herein.

Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Various systems and methods are disclosed for repairing, strengthening, hardening, or uprating a utility pole, and will now be described with reference to the accompanying figures.

As described herein, embodiments of the disclosed technology include utility pole repair plates for strengthening, uprating, hardening, or repairing a damaged or weakened utility pole and methods of using the same. Utility poles are commonly manufactured to have a polygonal cross-sectional shape. For example, FIG. 1 shows a cross-sectional view of an 8-sided utility pole 100 according to some embodiments. According to the embodiment shown in FIG. 1, the utility pole 100 has eight sides and forms an approximately regular octagon such that each side of the utility pole 100 is approximately the same length and all of the angle formed between each pair of two adjacent sides is approximately equal. As will be understood by those of skill the in the art, each internal angle between two adjacent sides of utility pole 100 is approximately 135 degrees. Although much of the disclosure refers to poles having a generally regular polygonal shape, it will be appreciated by those having skill in the art that combinations of repair plates of the present disclosure may also be utilized to service poles that do not have a regular polygonal cross section, such as, for example, faceted oval-shaped poles.

Figure 2A:
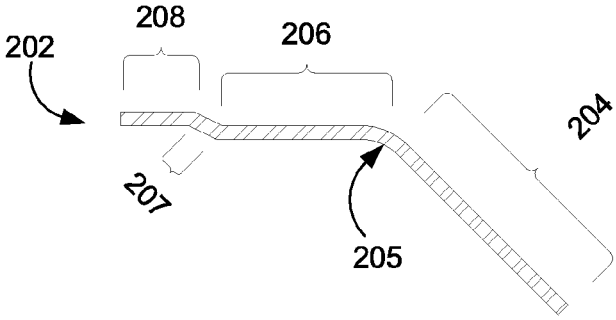
FIG. 2A is a side view of a utility pole repair plate, according to an example embodiment.

FIG. 2A shows an embodiment of a utility pole repair plate 202 designed for use with an 8-sided utility pole 100. According to some embodiments, a utility pole repair plate 202 may be made of a single piece of formed metal, having a top edge, two side edges, and a bottom edge. According to some embodiments, a utility pole repair plate 202 may be made of steel, copper, aluminum, stainless steel, fiber reinforced polymer (FRP), or any other suitable metal, alloy, or composite.

According to some embodiments, a utility pole repair plate 202 may include a first substantially planar plate segment 204 attached to a second substantially planar plate segment 206, such that the second plate segment 206 is positioned relative to the first plate segment 204 at an angle. According to some embodiments, the second plate segment 206 may be positioned relative to the first plate segment 204 at an angle designed to approximately match the angle between two adjacent outer surfaces of a utility pole. Thus, for an 8-sided utility pole 100, this angle may be approximately a 135 degrees. Throughout this disclosure, references to an approximation of an angle are intended to include angles within 5 degrees of the stated angle. For example, "approximately a 135 degree angle" may refer to any angle in the range of 130 to 140 degrees. In some embodiments, a first substantially planar plate segment 204 may be attached to a second substantially planar plate segment 206 at a shoulder 205. As shown in FIG. 2A, in some embodiments a shoulder 205 can be a rounded surface formed between the first plate segment 204 and the second plate segment 206. According to some embodiments, a rounded shoulder may have an inside bend radius that is the same as the outside bend radius of the utility pole. According to some embodiments, the inside bend radius of the utility pole 100 may be assumed to be 4 times the thickness of the pole, unless otherwise known. In some embodiments, a shoulder 205 may be a non-rounded edge formed between the first plate segment 204 and second plate segment 206. In some embodiments, the shoulder 205 may bulge outwards so that it may have room to accommodate extra material present on a vertex of the exterior surface of a utility pole. According to some embodiments, the shoulder 205 can be affixed to a utility pole by, for example, welding.

In some embodiments, a third substantially planar plate segment 207 may be connected to the second substantially planar plate segment 206. The third plate segment 207 may extend away from the second planar plate segment at a non-zero angle. According to some embodiments, the length of the third substantially planar plate segment 207 and the angle from which it extends away from the second planar plate may be intended to create an offset distance of a particular value, wherein the offset distance is a distance to the far end of the third plate segment 207, measured perpendicularly from the outside face of the second plate segment 206. According to some embodiments, the offset distance may be substantially equal to the thickness or width of a first planar plate segment 204 of an adjacent utility pole repair plate 202, such that the first plate segment 204 may be snuggly positioned between the face of a utility pole 100 and a fourth substantially planar plate segment 208 extending from the third plate segment 207 disposed in a substantially parallel direction to the second plate segment 206. According to some embodiments, the third plate segment 207 may extend away from the second plate segment 206 at, for example, but not limited to, a 45 degree angle, a 154 degree angle, or a 26 degree angle. It will be understood by those of skill in the art that according to various embodiments, the third plate segment 207 may extend away from the second plate segment 206 at any number of different angles and that the angles that have been provided herein are merely non-limiting examples.

In some embodiments, a fourth substantially planar plate segment 208 may be connected to the third substantially planar plate segment 207. As shown in FIG. 2A, according to some embodiments, the fourth plate segment 208 may extend away from the third plate segment 207 such that is disposed in a position that is substantially parallel to the direction of the second plate segment 206. Accordingly, in some embodiments, the fourth plate segment 208 may run parallel to the second plate segment 206, offset by an offset distance that is a function of the length of the third plate segment 207 as well as the angle between the third plate segment 207 and the second plate segment 206. According to some embodiments, the offset distance between the second plate segment 206 and fourth plate segment 208 may be approximately equal to the width or thickness of the first substantially planer plate segment 204.

Figure 2B:
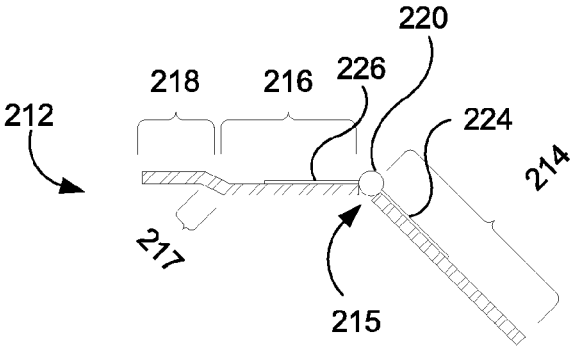
FIG. 2B is a side view of a hinged utility pole repair plate, according to an example embodiment.

FIG. 2B shows an embodiment of a utility pole repair plate 212 having a hinge 220 disposed between a first substantially planar plate segment 214 and a second substantially planar plate segment 216. In some embodiments, a hinge 220 may include attachment members 224, 226 that can attach hinge 220 to the first and second plate segments 214, 216. For example, the attachment members 224, 226 can be substantially planar members that attach to the back surface of the first and second plate segments 214, 216, respectfully. According to some embodiments, the attachment members 224, 226 can be welded to the first and second plate segments 214, 216, respectfully. In some embodiments, attachment members 224, 226 may be omitted and the first and second plate segments 214, 216 may attach directly to the hinge 220. The first plate segment 214 may be disposed at a hinge angle 215 relative to the second plate segment 216. In some embodiments, the hinge 220 can enable the first plate segment 214 to rotate relative to the second plate segment 216, thereby allowing for the hinge angle 215 to be adjustable. Similar to the embodiment shown in FIG. 2A, a hinged utility pole repair plate 212 may also include a third substantially planar plate segment 217 attached to the second plate segment 216 and a fourth substantially planar plate segment 218 extending away from the third plate segment 217. The fourth substantially planar plate segment 218 of a hinged repair plate 212 may be disposed substantially parallel to the second plate segment 216 and be offset by an offset distance. According to some embodiments, the offset distance may be substantially equal to the width or thickness of the first plate segment 214.

Figure 3A:
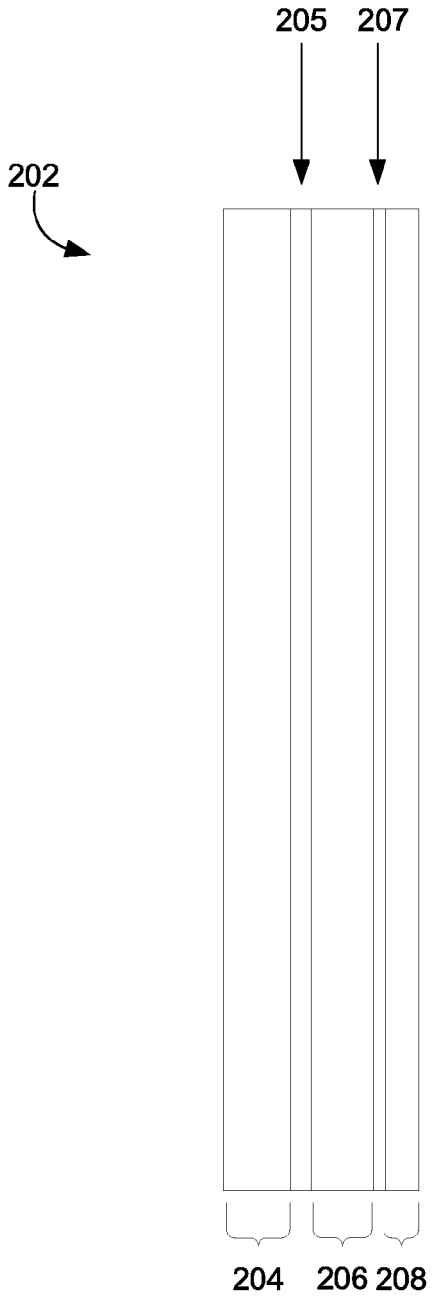
FIG. 3A is a side view of a utility pole repair plate, according to an example embodiment.
Figure 3B:
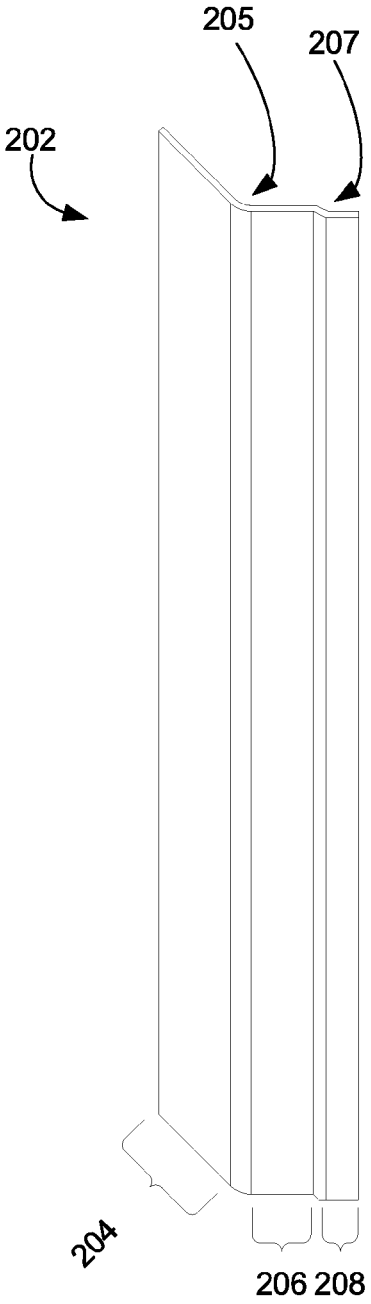
FIG. 3B is a perspective view of a utility pole repair plate, according to an example embodiment.

According to some embodiments, the substantially planar plate segments 204, 206, 207, 208 of a utility pole repair plate 202 described above may each be a generally flat piece of metal. FIGS. 3A and 3B show a side view and perspective view of an embodiment of a utility pole repair plate 202 having a first substantially planar plate segment 204, a second substantially planar plate segment 206, a third substantially planar plate segment 207, and a fourth substantially planar plate segment 208. In some embodiments, each plate segment 204, 206, 207, 208 can be made of steel, copper, aluminum, stainless steel, fiber reinforced polymer (FRP), or any other suitable metal or alloy. According to some embodiments, all of the plate segments 204, 206, 207, 208 may be made of the same material. In some embodiments, one or more of the plate segments 204, 206, 207, 208 may be made of different materials. According to some embodiments, a utility pole repair plate 202 may have a minimum thickness that is 1/16 inch thicker than the utility pole wall. In some embodiments, if the utility pole has a wall thickness of less than ¼ inch, than a utility pole repair plate 202 may have the same thickness as the utility pole wall.

Figure 4:
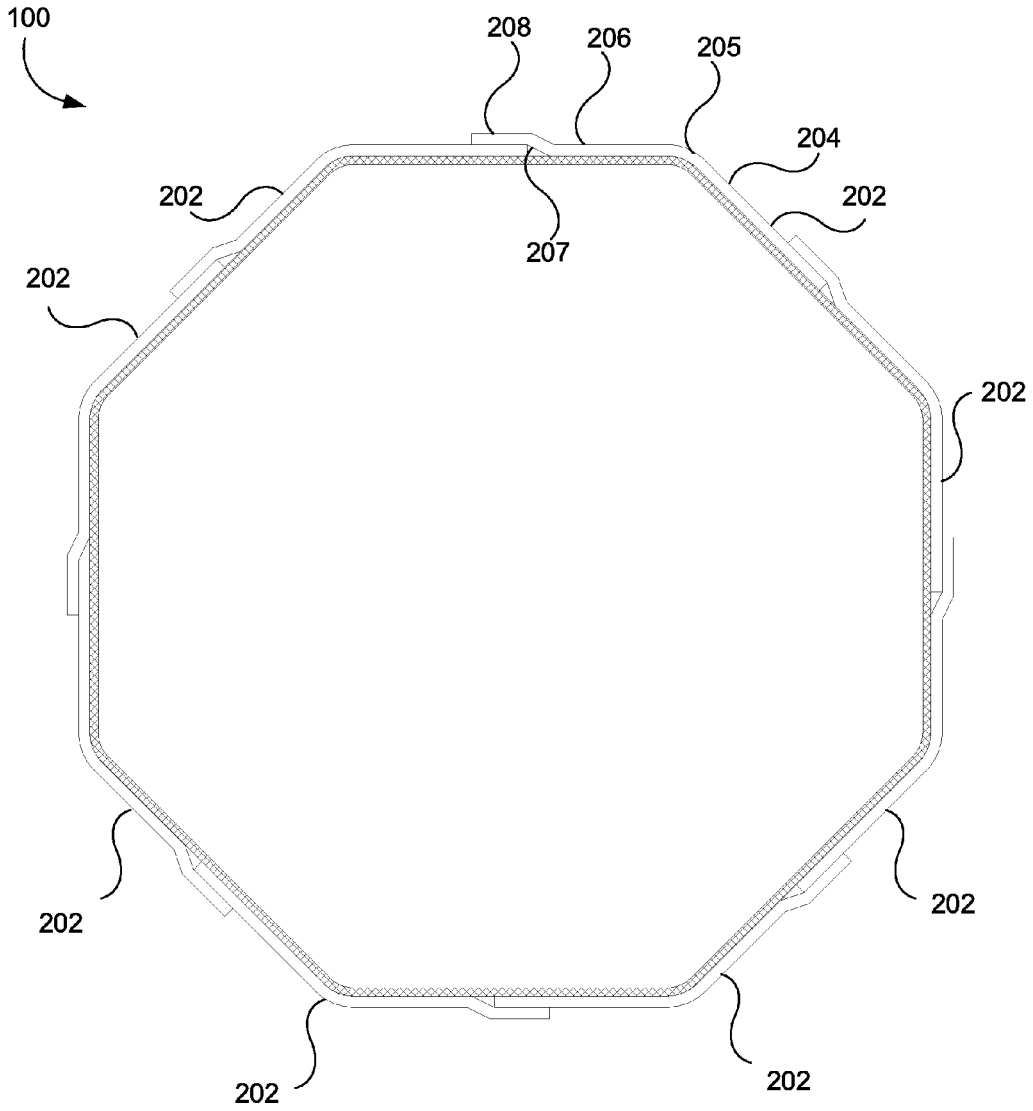
FIG. 4 is a cross-sectional top view of an 8-sided utility pole fitted with a set of utility pole repair plates, according to an example embodiment.

According to some embodiments, the utility pole repair plate 202 may be configured to be affixed to two faces of a utility pole 100. Furthermore, in some embodiments, a fourth substantially planar plate segment 208 of a first utility pole repair plate 202 may attach to the first substantially planar plate segment 204 of a second utility pole repair plate 202. FIG. 4 shows a plurality of utility pole repair plates 202 affixed to a utility pole 100. As shown in FIG. 4, for a particular utility pole repair plate 202, the first substantially planar plate segment 204 may be affixed to a first face of the utility pole 100, and the second substantially planar plate segment 206 may be affixed to a second, adjacent face of the utility pole 100. Furthermore, in some embodiments, the shoulder 205 of the utility pole repair plate may generally straddle the intersection of the first and second faces of the utility pole 100, such that the surface of the first and second plate segments 204, 206 may be positioned substantially flush against the surface of the utility pole 100. As shown in FIG. 4, according to some embodiments, a first substantially planar plate segment 204 of a second utility pole repair plate 202 may be positioned between a face of the utility pole 100 and a surface of the fourth substantially planar plate segment 208 of a first repair plate 202. In this way, each utility pole repair plate 202 may be capable of receiving an end of an adjacent plate. Thus, as shown in FIG. 4, in some embodiments, when secured to the utility pole 100, utility pole repair plates 202 can be placed around the entire circumference of the utility pole 100. In some embodiments, one or more utility pole repair plates 202 may be attached to a utility pole 100 to cover a portion of the utility pole 100 that is less than the entire circumference of the utility pole 100. According to some embodiments, the first and second plate segments 204, 206 of a utility pole repair plate 202 may be affixed to the surface of a utility pole 100 by welding the plate segments 204, 206 to the surface of the utility pole 100. According to some embodiments, welding can be performed in the flat position, such that the joint is laid flat. In some embodiments, welds may be fillet welds. According to some embodiments, a top and/or bottom portion of a utility pole repair plate 202 can be "scalloped" into a half-circle along the flats to create a shape similar to a castellated nut, which may enable the weld to develop additional strength and provide additional fatigue resistance. By scalloping the plates, the weld length can be increased which may allow a stronger connection to the pole to be achieved with a single side fillet weld. In some embodiments, a first utility pole repair plate 202 may be affixed to a second utility pole repair plate 202 by welding a surface of the fourth plate segment 208 of the first repair plate 202 to a surface of the first plate segment 204 of the second repair plate 202. In some embodiments, a repair plate may be affixed to the utility pole 100 or another repair plate 202 by using bolts, pins, screws, epoxy, adhesive, blind bolts, or any other such attachment means. For example, in some embodiments, the first plate segment 204 may include attachment members, such as bolts or screws, which may extend substantially perpendicularly away from the surface of the first plate segment 204, which can be received by holes in the fourth plate segment 208 of another repair plate 202. According some embodiments, the first plate segment 204 of a first utility pole repair plate 202 and a fourth plate segment 208 of a second utility pole repair plate 202 can each have holes that align with one another when the utility pole repair plates 202 are applied to a utility pole, and the first and second utility pole repair plants may be secured to the pole by an attachment member, such as a screw or bolt, extending through the holes and into the surface of the utility pole. According to some embodiments, if a repair plate 202 is used to repair a section of a utility pole 100 at a base plate or at a bolted flange connection such that it may be welded to the base plate or bolted flange connection, the top end of the repair plate 202 which will not be attached to the base plate or flange can be "scalloped" as described above. In some embodiments, the opposite end of the repair plate 202 which may attach to the base plate or flange may have a lap joint terminate at a distance, for example, 4 inches, above that connection. Accordingly, in some embodiments, the bottom portion of the repair plate 202 may have an extra flat steel projecting horizontally from the vertical edge of the repair plate 202 to allow field trimming and proper fitting for a complete joint penetration (CJP) weld to be performed on the bottom portion of the repair plate 202. According to some embodiments, such a design may simplify the fit-up for the additional CJP weld that may attach the bottom of the repair plate 202 to the base plate or flange.

As described above, utility pole repair plates 202 may be attached to a utility pole 100 through welding or bolting. In some embodiments, a welded repair may involve positioning one or more utility pole repair plates 202 over the area to be reinforced and temporarily attaching it to the utility pole. According to some embodiments, repair plate lap joints may be tack welded to lock in the profile (i.e., the shape of the existing pole), thereby creating a utility pole repair plate assembly that includes a plurality of utility pole repair plates 202 that have been attached to one another. In some embodiments, the repair plate assembly may be removed from the surface of the utility pole and the lap joints on the interior of the repair plate assembly may be stitch welded. In some embodiments, the exterior of the lap joints of the repair plate assembly may be fully welded. As such, in some embodiments, a utility pole repair plate assembly may be created by attaching a plurality of utility pole repair plates 202 to one another in advance of securing the repair plate assembly to the utility pole. According to some embodiments, the interior of the repair plates 202 or utility pole repair plate assembly and the exterior of the utility pole 100 face may be coated with a specified coating system. A coating system can be used to protect the repair plates 202 from corrosion and may also be used to improve the aesthetics of the repair plates 202. Examples of specified coating systems that can be used include, but are not limited to, a cold galvanizing compound, or various single or multi-coat systems such as zinc-rich primer, epoxy primer/midcoat, or polyurethane topcoat. In some embodiments, after being removed and welded together, the utility pole repair plate assembly may be positioned back on the utility pole 100 and the repair plate assembly may be fully welded to the utility pole 100. In some embodiments, the entire repair may be coated with a specified coating system, including the interior of the pole, when applicable. According to some embodiments, if this method is used to repair the entire circumference of the utility pole 100, the above steps may be performed on each half of the utility pole 100, thereby creating two repair plate assemblies. For example, a first repair plate assembly may be configured to cover a first half of the utility pole and a second repair plate assembly may be configured to cover the second half of the utility pole, such that the two halves may be joined and attached together to cover the entire circumference of the utility pole. According to some embodiments, there may be two longitudinal joints joining both halves of two repair plate assemblies and the longitudinal joints may correlate with the neutral axis of the pole.

According to some embodiments, the utility pole repair plates 202 may be utilized to perform a bolted repair of the utility pole 100. In some embodiments a repair plate 202 may be positioned over the pole area to be reinforced and the utility pole 100 may be marked for drilling, or match-drilled, using a positioning hole of the repair plate 202. The repair plate 202 may be removed and a positioning hole may be drilled into the pole. According to some embodiments, the inside face of the repair plate 202 may be coated with a specified coating system and sealed with a specified sealant to prevent moisture from penetrating the repaired area. The repair plate 202 may be repositioned and secured to the utility pole by using, for example, epoxy or a blind bolt. According to some embodiments, additional holes may be drilled in the repair plate 202, continuing through the pole wall, and additional bolts may be installed. According to some embodiments, this process may be repeated until the required number of repair plates have been attached to the utility pole 100. In some embodiments, after the repair plates 202 are attached to the utility pole 100, each lap splice may be drilled through both laps and the pole wall and blind bolts may be installed. According to some embodiments, some or all of the repair plates 202 and interior of the utility pole may be coated with a specified coating system to complete the repair.

According to some embodiments, a damaged or weakened portion of an 8-sided utility pole 100 may be repaired by affixing one or more utility pole repair plates 202 around the pole in at least one or more of the manners described above, such that the surface of the one or more utility pole repair plates covers the damaged or weakened portion of the utility pole 100. According to some embodiments, a hinged utility pole repair plate 212 may be affixed to a utility pole 100 in a manner similar to those of the utility pole repair plate 202 described above, however, the existence of the hinge 220 may enable a user to more easily position the repair plate 212 on the utility pole 100 and relative to adjacent or interconnected repair plates 212. Further, the existence of the hinge 220 may also allow the utility pole repair plate 212 to be accommodate a wider variation of pole shapes and sizes. For example, according to some embodiments, the hinged repair plate 212 may fit on most or all of the different polygonal pole shapes, since the hinge allows all of the different angles to be matched. According to some embodiments, one or more hinged utility pole repair plates 212 may be used in combination with utility pole repair plates 202 to repair an 8-sided utility pole 100.

Figure 5:
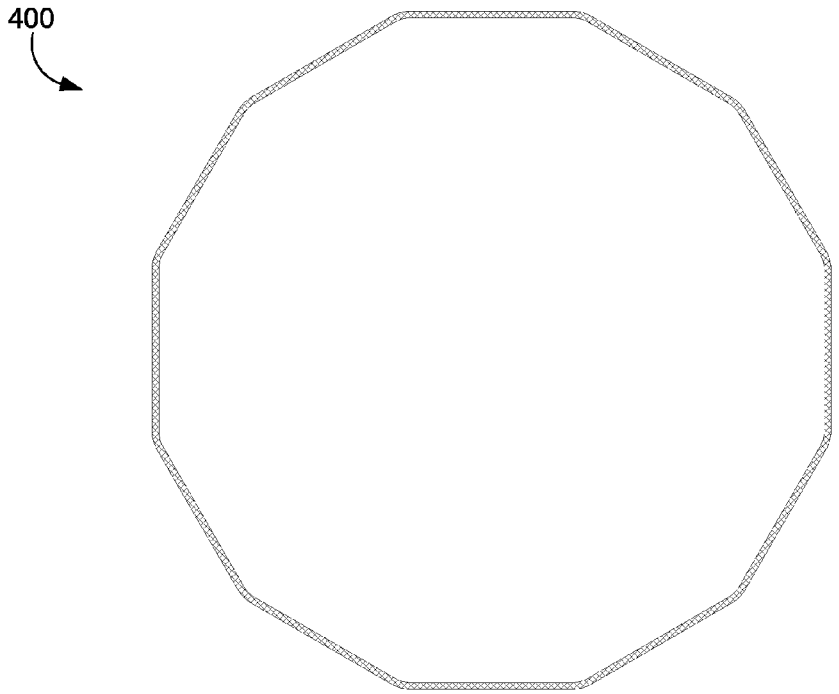
FIG. 5 is a cross-sectional top view of a 12-sided utility pole, according to an example embodiment.
Figure 6A:
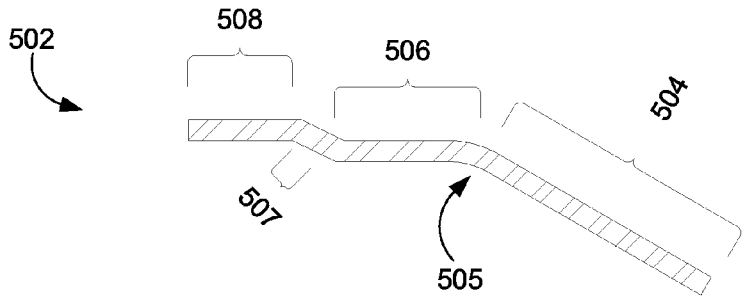
FIG. 6A is a side view of a utility pole repair plate, according to an example embodiment.
Figure 6B:
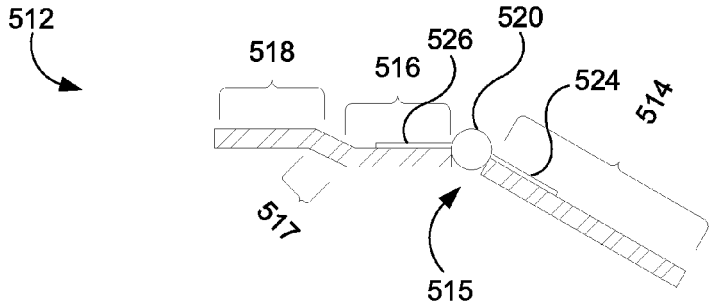
FIG. 6B is a side view of a hinged utility pole repair plate, according to an example embodiment.
Figure 7:
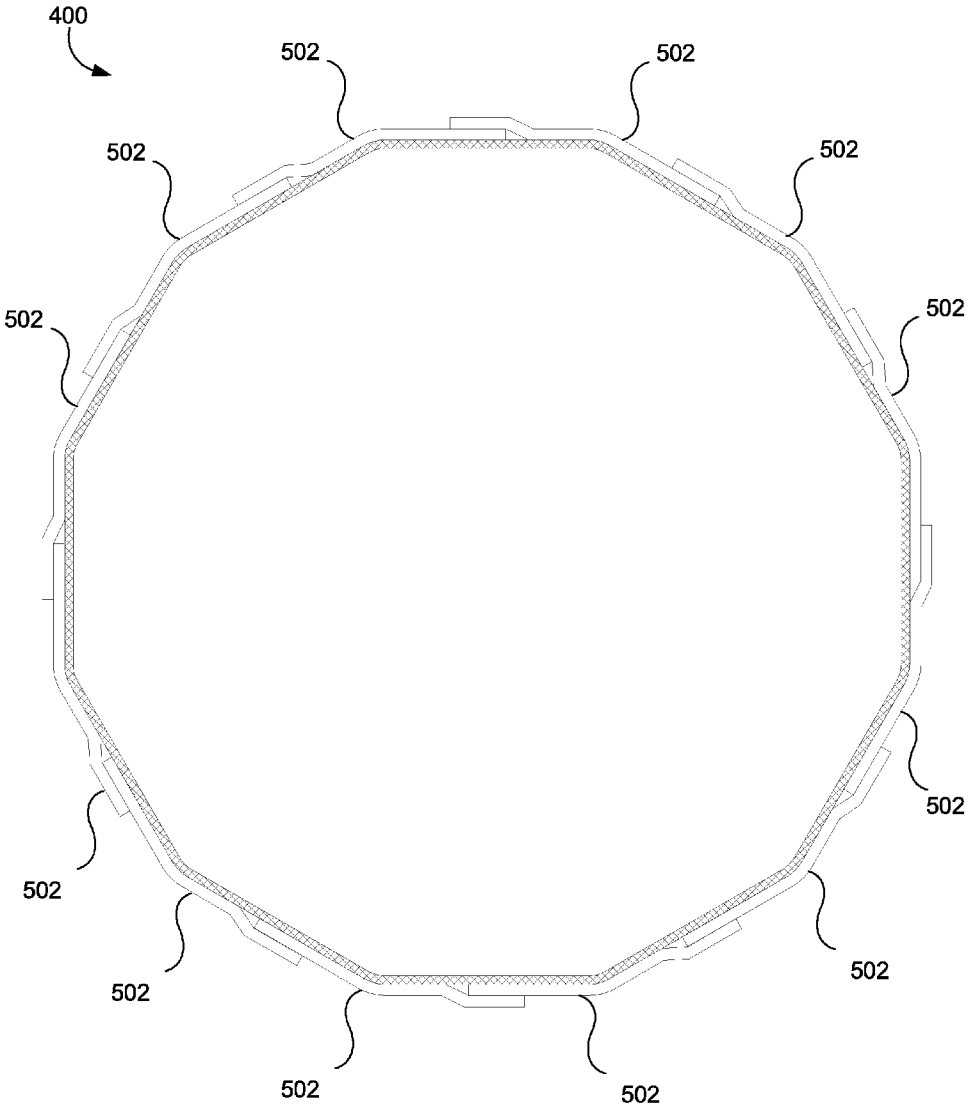
FIG. 7 is a cross-sectional top view of a 12-sided utility pole fitted with a set of utility pole repair plates, according to an example embodiment.

As previously discussed, utility poles are manufactured in a variety of geometries. According to various embodiments, the angle formed between the first plate segment and a second plate segment of a repair plate may correspond to the angle formed between two adjacent sides of a pole. In some embodiments, the angle formed between the first plate segment and a second plate segment may be approximately equal to the 360° divided by the number of sides of the pole. FIG. 5 illustrates a top cross-sectional view of a 12-sided utility pole 400. As will be understood by those of skill in the art, a regular 12-sided utility pole has 12 sides of approximately equal length, and internal angles of 150 degrees formed between each pair of adjacent sides. FIG. 6A illustrates a utility pole repair plate 502 configured to repair a 12-sided utility pole 400. According to some embodiments, a repair plate 502 may include a first substantially planar plate segment 504, a shoulder 505, a second substantially planar plate segment 506, a third substantially planar plate segment 507, and a fourth substantially planar plate segment 508. According to some embodiments, the angle formed between the first plate segment 504 and second plate segment 506 may be designed to approximately match the angle between two adjacent outer surfaces of a utility pole. Thus, for a 12-sided utility pole 400, this angle may be approximately 150 degrees. Similarly, FIG. 6B shows a hinged utility pole repair plate 512 having a first substantially planar plate segment 514, a second substantially planar plate segment 516, a third substantially planar plate segment 517, a fourth substantially similar planar plate segment 518, and a hinge 520 having attachment members 524, 526. In some embodiments of a hinged utility pole repair plate 512, attachment members 524, 526 may be omitted and the first and second plate segments 514, 516 may attach directly to the hinge 520. As will be appreciated by those of skill in the art, a utility pole repair plate 502 and hinged utility pole repair plate 512 may be used to repair a 12-sided utility pole 400 in the same manner that the utility pole repair plate 202 and hinged utility pole repair plate 212 may be used to repair an 8-sided utility pole 100 as described above. FIG. 7 illustrates a plurality of utility pole repair plates 502 affixed to a 12-sided utility pole 400.

Figure 8:
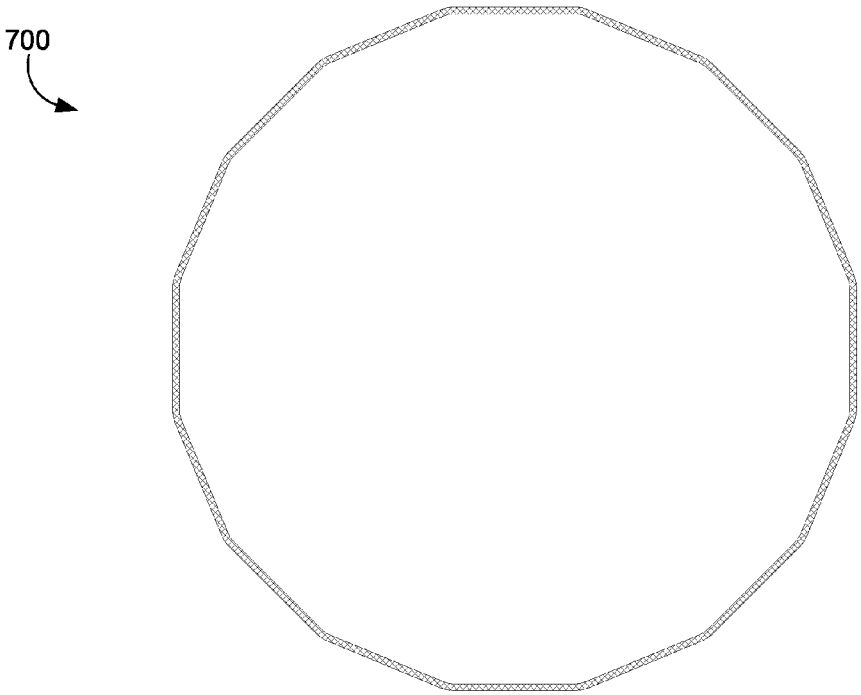
FIG. 8 is a cross-sectional top view of a 16-sided utility pole, according to an example embodiment.
Figure 9A:
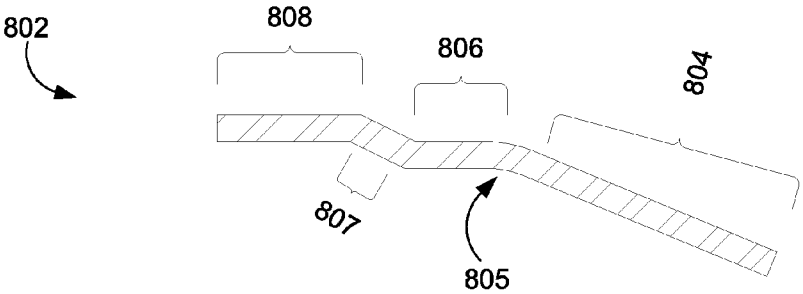
FIG. 9A is a side view of a utility pole repair plate, according to an example embodiment.
Figure 9B:
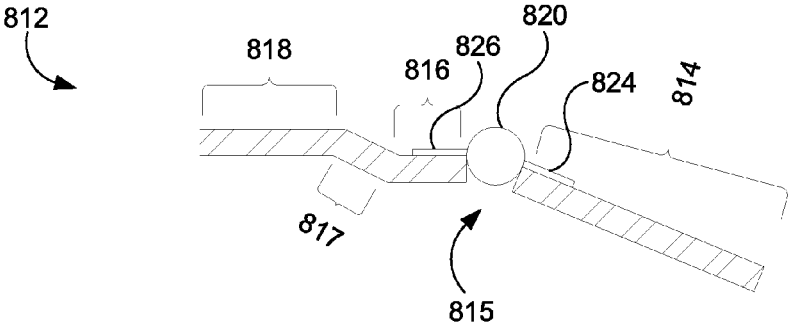
FIG. 9B is a side view of a hinged utility pole repair plate, according to an example embodiment.
Figure 10:
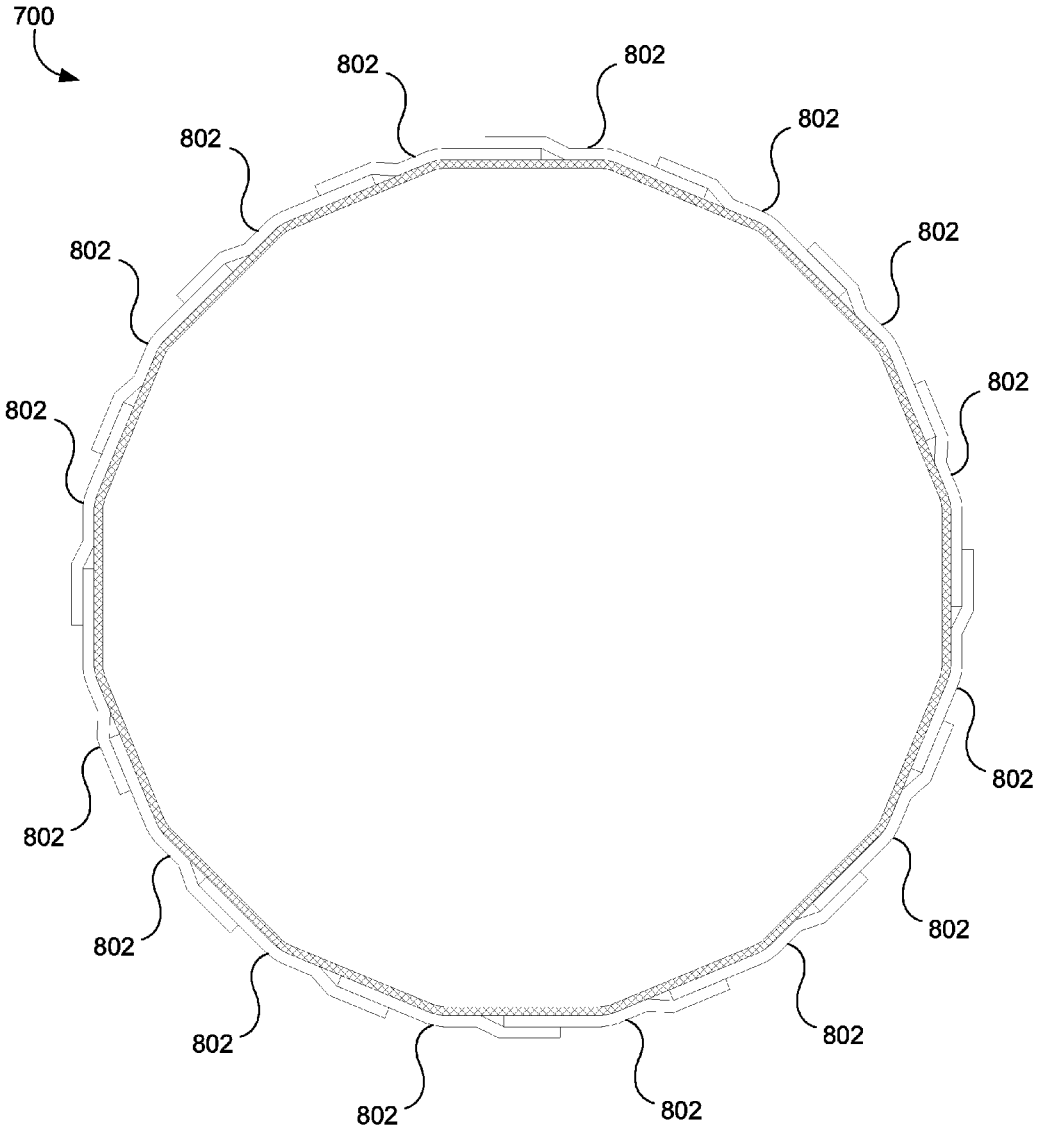
FIG. 10 is a cross-sectional top view of a 16-sided utility pole fitted with a set of utility pole repair plates, according to an example embodiment.

FIG. 8 illustrates a top cross-sectional view of a 16-sided utility pole 700. As will be understood by those of skill in the art, a regular 16-sided utility pole has 16 sides of approximately equal length, and internal angles of 157.5 degrees formed between each pair of adjacent sides. FIG. 9A illustrates a utility pole repair plate 802 configured to repair a 16-sided utility pole 700. According to some embodiments, a repair plate 502 may include a first substantially planar plate segment 804, a shoulder 805, a second substantially planar plate segment 806, a third substantially planar plate segment 807, and a fourth substantially planar plate segment 808. According to some embodiments, the angle formed between the first plate segment 804 and second plate segment 806 may be designed to approximately match the angle between two adjacent outer surfaces of a utility pole. Thus for a 16-sided utility pole, this angle may be approximately 157.5 degrees. Similarly, FIG. 9B shows a hinged utility pole repair plate 812 having a first substantially planar plate segment 814, a second substantially planar plate segment 816, a third substantially planar plate segment 817, a fourth substantially similar planar plate segment 818, and a hinge 820 having attachment members 824, 826. In some embodiments of a hinged utility pole repair plate 812, attachment members 824, 826 may be omitted and the first and second plate segments 814, 816 may attach directly to the hinge 820. As will be appreciated by those of skill in the art, a utility pole repair plate 802 and hinged utility pole repair plate 812 may be used to repair a 12-sided utility pole 700 in the same manner that the utility pole repair plate 202 and hinged utility pole repair plate 212 may be used to repair an 8-sided utility pole 100 as described above. FIG. 10 illustrates a plurality of utility pole repair plates 502 affixed to a 12-sided utility pole 400.

Figure 11A:
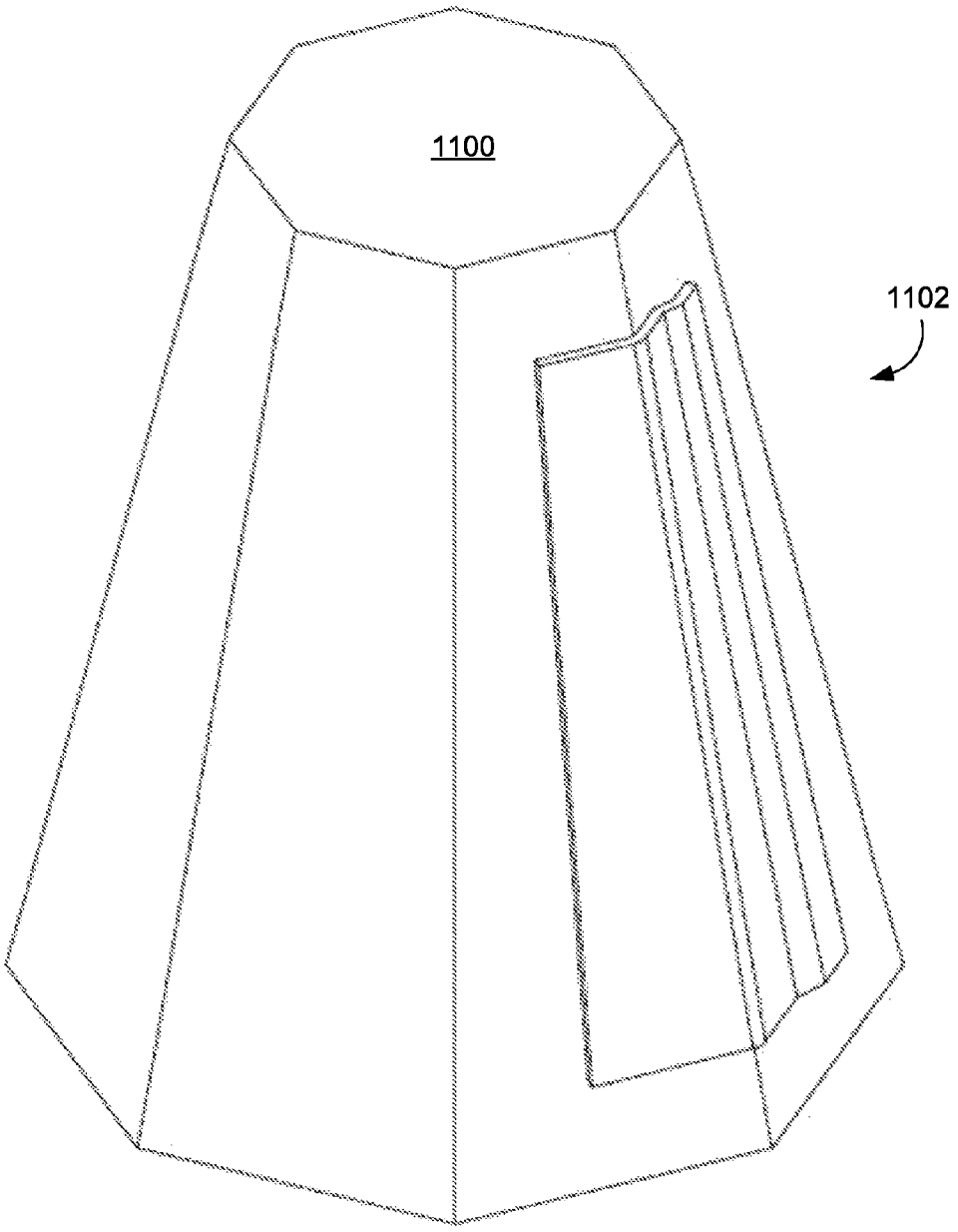
FIG. 11A is a perspective view of a utility pole repair plate positioned on a tapering utility pole, according to an example embodiment.
Figure 11B:
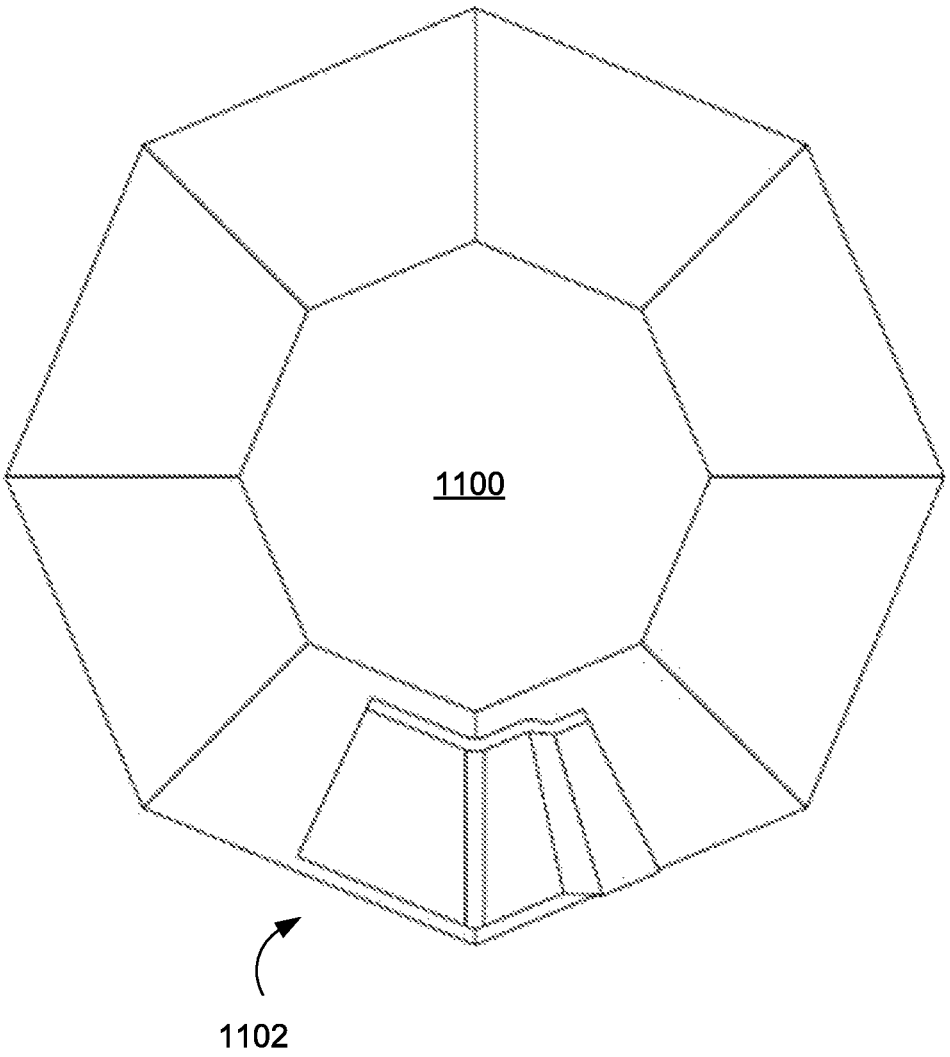
FIG. 11B is a top view of a utility pole repair plate positioned on a tapering utility pole, according to an example embodiment.
Figure 11C:
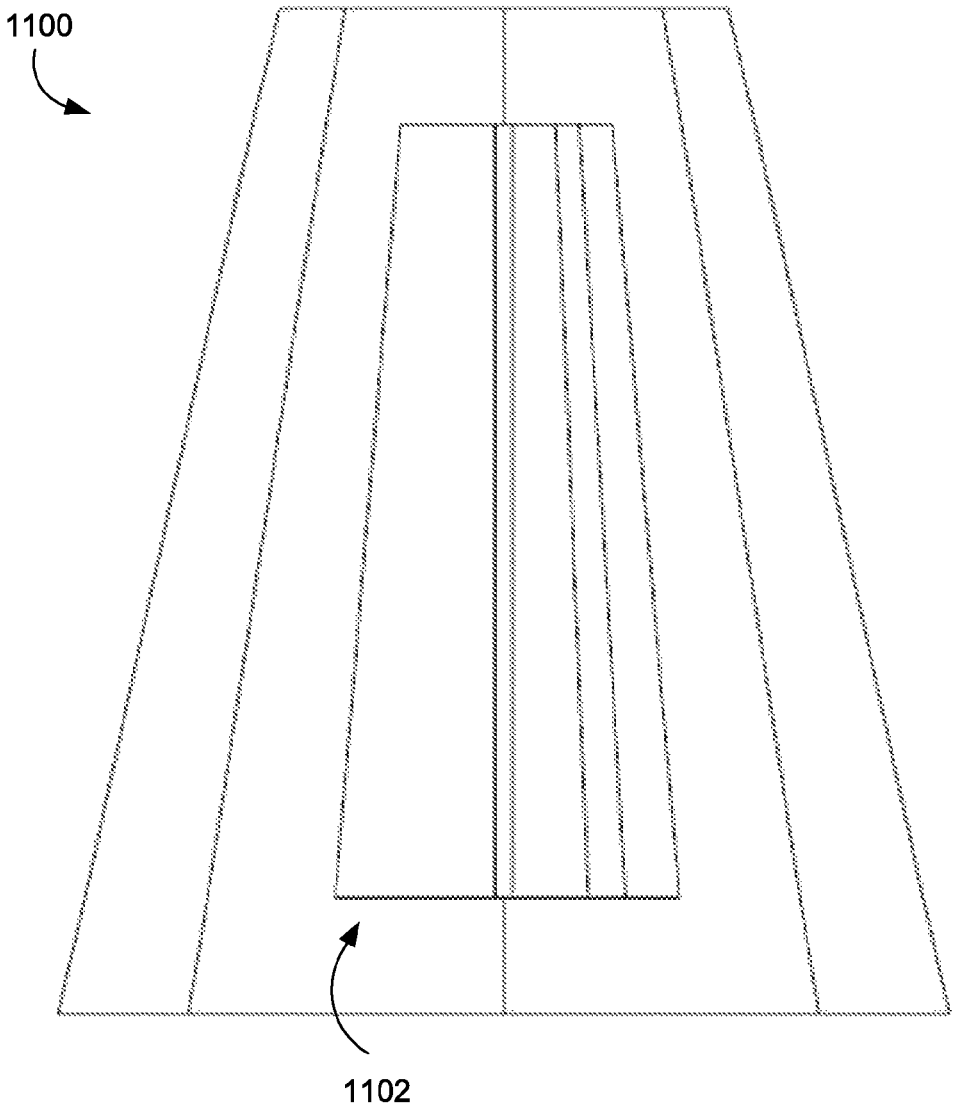
FIG. 11C is a side view of a utility pole repair plate positioned on a tapering utility pole, according to an example embodiment.
Figure 12A:
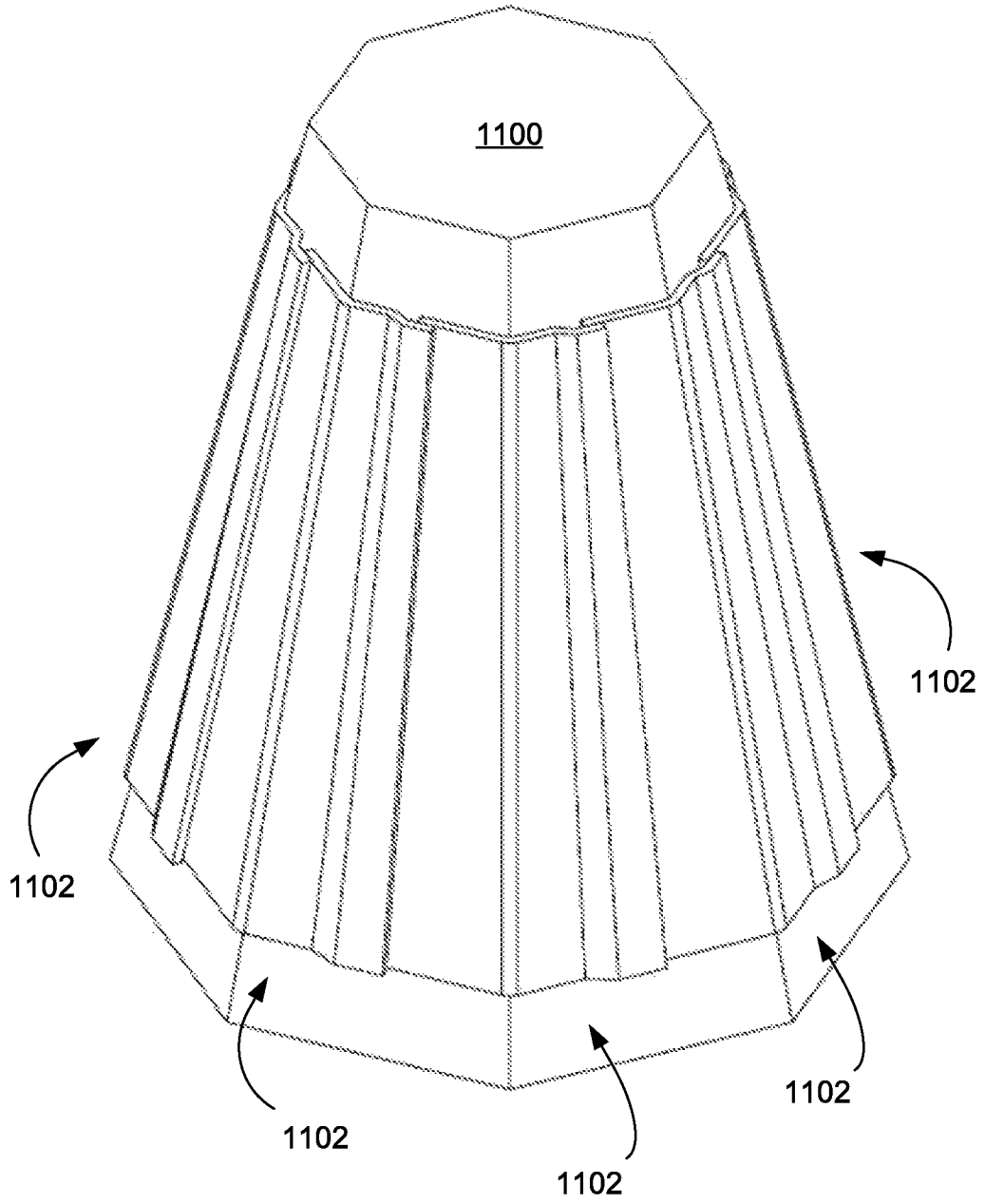
FIG. 12A is a perspective view of a plurality of utility pole repair plates positioned on a tapering utility pole, according to an example embodiment.
Figure 12B:
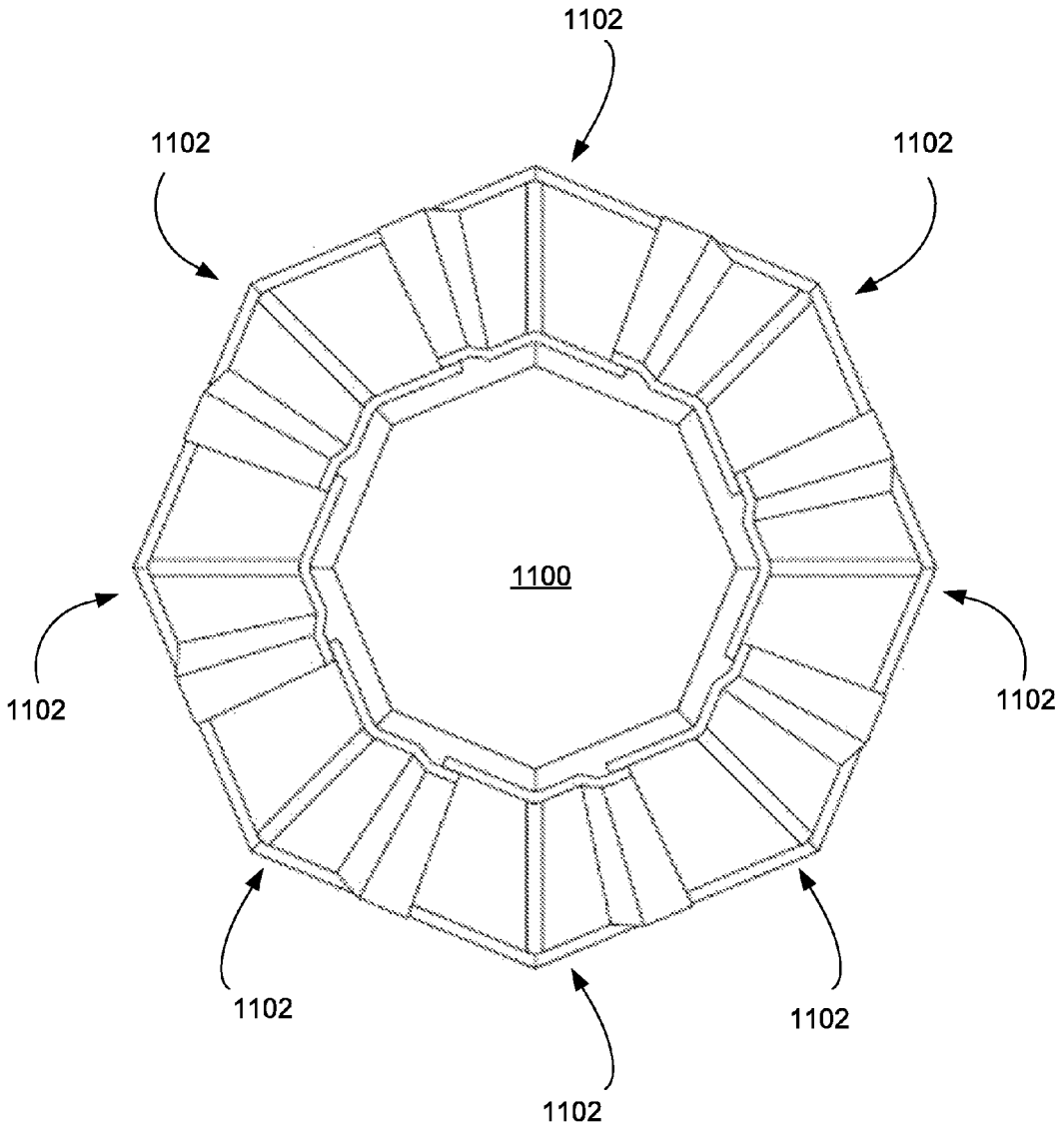
FIG. 12B is a top view of a plurality of utility pole repair plates positioned on a tapering utility pole, according to an example embodiment.

While some utility poles maintain a substantially constant diameter from the base of the utility pole to the top of the utility pole, others are designed to taper from the top to the bottom, such that the diameter of the utility pole becomes smaller towards the top. Accordingly, some embodiments of a utility pole repair plate can include a tapered design, such that the widths of each substantially planar plate segment become smaller on the top edge of the repair plate. FIGS. 11A-11C show various views of a tapered utility pole 1100 having a tapered utility pole repair plate 1102 affixed to it. Tapered utility pole 1100 is depicted to show an exaggerated taper for the purposes of illustration. As shown in these figures, according to some embodiments, the overall width of a tapered utility pole repair plate 1102 is smaller at the top edge of the repair plate 1102 than the bottom edge of the repair plate 1102. In some embodiments, the widths of each plate segment that makes up the repair plate 1102 shrinks towards the top edge of the repair plate 1102. FIGS. 12A-B show a plurality of tapered utility pole repair plates 1102 affixed to the tapered utility pole 1100. Any of the aforementioned embodiments of the utility pole repair plates described herein may also incorporate the tapering aspect shown in these figures. According to some embodiments, a tapered utility pole repair plate may not be required to repair a tapered pole because one or more lap joints of one or more non-tapered utility pole repair plates of the present disclosure may accommodate utility pole taper or other imperfections. According to some embodiments, a lap joint can be formed by the overlapping portions of two adjacent utility pole repair plates. For example, in FIG. 4, a lap joint may be formed between the joining of the fourth substantially planar plate segment 208 of a first utility pole repair plate 202 and the first plate segment 204 of a second utility pole repair plate 202.

Figure 13:
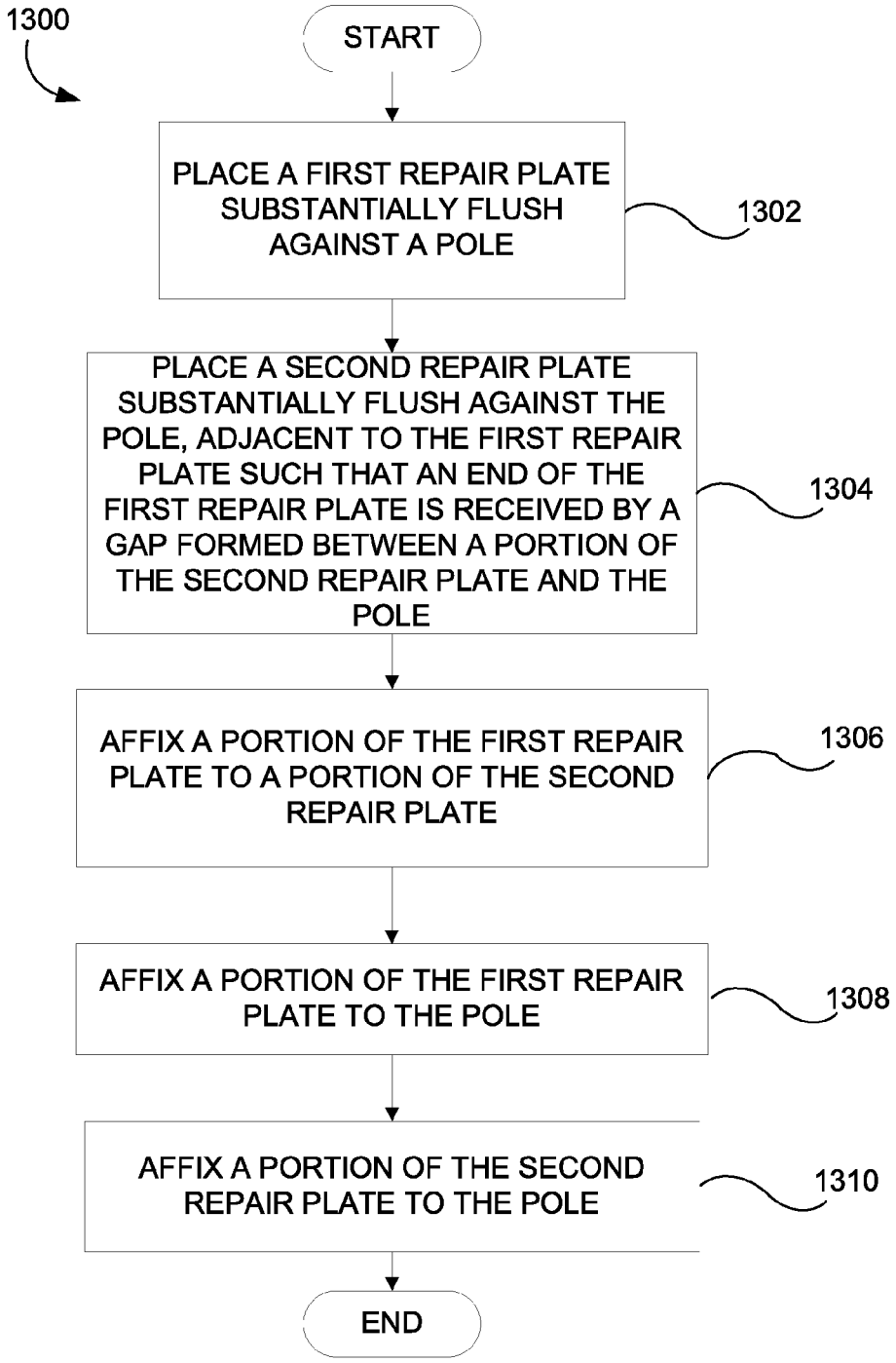
FIG. 13 is a flow diagram of a method 1300, according to an example implementation.

FIG. 13 is a flow diagram of a method 1300, according to an example implementation. As shown in FIG. 13, in some implementations, the method includes, at 1302, placing a first repair plate substantially flush against a pole. According to some embodiments, a first repair plate may include: a first substantially planar plate segment, a second substantially planar plate segment connected to the first substantially planar plate segment at a shoulder, the first substantially planar plate segment disposed at a first angle from the second substantially planar plate segment, a third substantially planar plate segment connected to the second substantially planar plate segment at a second angle, and a fourth substantially planar plate segment connected to the third substantially planar plate segment, the fourth substantially planar plate segment including the second side edge of the repair plate, the fourth substantially planar plate segment disposed in a substantially parallel direction to the second planer plate segment and offset from the second substantially planar plate segment by an offset distance. In some embodiments, the first substantially planar plate segment may be positioned flush against a first side of the pole, and the second substantially planar plate segment may be positioned flush against a second side of the pole, wherein the second side of the pole is adjacent to the first side of the pole. At 1304, the method can include placing a second repair plate substantially flush against the pole, wherein the second repair plate is placed adjacent to the first repair plate. According to some embodiments, the second repair plate may be placed such that: a first substantially planar plate segment of the second repair plate is positioned flush against the second side of the pole, a second substantially planar plate segment of the second repair plate is positioned flush against a third side of the pole, wherein the third side of the pole is adjacent to the second side of the pole, and the end of the first substantially planar plate segment of the second repair plate is received by the gap formed between the fourth substantially planar plate segment of the first repair plate and the surface of the second side of the pole. At 1306, the method can include affixing the first substantially planar plate segment of the second repair plate to the fourth substantially planar plate segment of the first repair plate. At 1308, the method can include affixing the first and second substantially planar plate segments of the first repair plate to the first and second sides of the pole, respectively. Lastly, at 1310, the method can include affixing the first and second substantially planar plate segments of the second repair plate to the second and third sides of the pole, respectively. In some embodiments, the repair plates may be affixed to one another or to the utility pole by using bolts, pins, screws, epoxy, adhesive, blind bolts, welding, or any other such attachment means.

Figure 14:
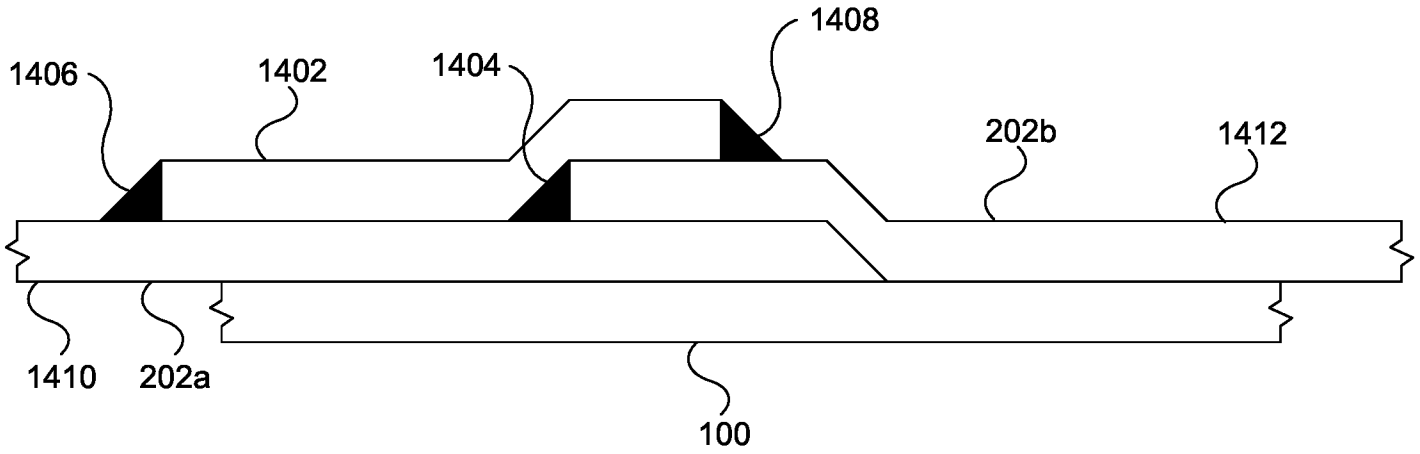
FIG. 14 is a cross-sectional view of a weld strip reinforcing the joint between two utility pole repair assemblies, according to an example implementation.

As described previously above, in some embodiments, utility pole repair plates 202 may be placed around a pole such that they cover the entire perimeter or circumference of the pole. In some embodiments, this may be achieved by creating two utility pole repair assemblies that each cover half of the circumference/perimeter of the pole and then placing the two utility pole repair assemblies on the surface of the pole such that they interconnect before then joining them together, by, for example, welding them together. According to some embodiments, a utility pole repair assembly may be created by temporarily positioning a plurality of utility pole repair plates 202 against the outer wall of the utility pole, such that they are interlocking in a roughly semi-circular configuration, and then tacking the utility pole repair plates 202 together. The tacked utility pole repair plates 202 may then be removed from the exterior of the utility pole and placed elsewhere, for example, on the ground, where they may then be fully welded together at the joints. Once two utility pole repair assemblies have been created, they may both be placed back around the outer wall of the utility pole, such that they interlock with one another, and then the two utility pole assemblies may be welded to one another and the utility pole. According to some embodiments, it may be desirable to provide additional strengthening to the two weld joints that join the two utility pole repair assemblies, as these joints may be fillet welded longitudinal joints that are only welded on one side of the connecting joint that joins a utility pole repair plate 202 of the first utility pole repair assembly with a utility pair repair plate 202 of the second utility pole repair assembly. These fillet welded joints may not be as strong as the all of the other longitudinal joints, which may be welded on both sides. FIG. 14 illustrates the use of a weld strip 1402 to provide additional strengthening to area at which the first utility pole repair assembly 1410 is attached to the second utility pole repair assembly 1412. As described above, utility pole repair plates 202 of the first utility pole repair assembly 1410 and second utility pole repair assembly 1412 may be attached, for example, by welding, to one another as well as the utility pole 100. According to some embodiments, a weld strip 1402 may have a first substantially planar plate segment, a second substantially planar plate segment extending away from the first substantially planar plate segment at a first angle, and a third substantially planer plate segment extending away from the second substantially planar plate segment at a second angle. According to some embodiments, the first and third substantially planar plate segments may be oriented to be approximately parallel. As shown in FIG. 14, a weld strip 1402 may be positioned such that the first substantially planar plate section is adjacent to a first substantially planar plate segment of the utility pole repair plate 202*a* of the first repair plate assembly and the third substantially planar plate segment of the weld strip 1402 is adjacent to the fourth substantially planar plate segment of the utility pole repair plate 202*b* of the second repair plate assembly. The first substantially planar plate segment of the weld strip 1402 may be welded 1406 to the first substantially planar plate segment of the utility pole repair plate 202*a* of the first repair plate assembly 1410 and the third substantially planar plate segment may be welded 1408 to the fourth substantially planar plate segment of utility pole repair plate 202*b* of the second repair plate assembly 1412. As will be understood by those of skill in the art, the attachment of the weld strip 1402 may strengthen and reinforce the single fillet weld 1404. According to some embodiments, welds 1406 and 1408 may be fillet welds. Those of skill in the art will further recognize there may be alternatives methods of strengthening the connection between the first repair plate assembly 1410 and the second repair plate assembly 1412, such as, for example, welding them together with a plug weld or a slot weld.

Although the previous description refers to two utility pole repair assemblies that each cover half of the perimeter of a pole, it should be understood that other proportions may be used. For example, in some embodiments a first utility pole repair assembly may cover 25% of the perimeter of the pole and a second utility pole repair assembly may cover 75% of the perimeter of the pole. Furthermore, in some embodiments, more than two utility pole repair assemblies may be used.

It will be understood that the various steps of any of the methods described herein are illustrative only, and that steps may be removed, other steps may be used, or the order of steps may be modified.

Certain embodiments of the disclosed technology are described above with reference to flow diagrams of systems and methods according to example embodiments of the disclosed technology. It will be understood that some blocks of the flow diagrams may not necessarily need to be performed in the order presented, or may not necessarily need to be performed at all, according to some embodiments of the disclosed technology.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A pole repair plate having a top edge, a bottom edge, a first side edge and a second side edge, the repair plate comprising:

a first substantially planar plate segment including the first side edge of the repair plate;

a second substantially planar plate segment connected to the first substantially planar plate segment at a shoulder, the first substantially planar plate segment disposed at a first angle from the second substantially planar plate segment;

a third substantially planer plate segment connected to the second substantially planar plate segment at a second angle; and a fourth substantially planar plate segment connected to the third substantially planar plate segment, the fourth substantially planar plate segment including the second side edge of the repair plate, the fourth substantially planar plate segment disposed in a substantially parallel direction to the second planer plate segment and offset from the second substantially planar plate segment by an offset distance, the offset distance being approximately equal to a width of the first substantially planar plate segment.

2. The pole repair plate of claim 1, wherein a surface of the fourth substantially planar plate segment is configured to lap a surface of a first plate segment of an adjacent repair plate.

3. The pole repair plate of claim 1, wherein the first substantially planar plate segment is configured to be placed flush against a first side of a pole and the second substantially planar plate segment is configured to be placed flat against a second side of the pole.

4. The pole repair plate of claim 3, wherein the fourth substantially planar plate segment is configured to be attached to an adjacent repair plate.

5. The pole repair plate of claim 4, wherein the fourth substantially planar plate segment is configured to be welded to the adjacent repair plate.

6. The pole repair plate of claim 4, wherein a surface of the fourth substantially planar plate segment comprises one or more holes designed to receive a corresponding one or more securing members extending from a surface of the adjacent repair plate.

7. The pole repair plate of claim 3, wherein the sides of the pole form the shape of a substantially regular polygon having four, six, eight, twelve, or sixteen sides, and the first angle is 360 degrees divided by the number of sides of the pole.

8. The pole repair plate of claim 1, wherein the plate tapers upwards from the bottom edge to the top edge.

9. The pole repair plate of claim 1, wherein the first angle is approximately 45 degrees, 135 degrees, 30 degrees, 150 degrees, 22.5 degrees, or 157.5 degrees.

10. The pole repair plate of claim 1, wherein the first angle is approximately equal to 360° divided by the number of sides of a pole that it is configured to repair.

11. The pole repair plate of claim 1, wherein the second angle is approximately 154 degrees or 26 degrees.

12. A method of repairing a pole comprising:

placing a first repair plate substantially flush against a pole, the first repair plate including:

a first substantially planar plate segment of the first repair plate;

a second substantially planar plate segment of the first repair plate connected to the first substantially planar plate segment of the first repair plate at a shoulder, the first substantially planar plate segment of the first repair plate disposed at a first angle from the second substantially planar plate segment of the first repair plate;

a third substantially planar plate segment of the first repair plate connected to the second substantially planar plate segment of the first repair plate at a second angle;

a fourth substantially planar plate segment of the first repair plate connected to the third substantially planar plate segment of the first repair plate, the fourth substantially planar plate segment of the first repair plate including a second side edge of the first repair plate, the fourth substantially planar plate segment of the first repair plate disposed in a substantially parallel direction to the second planer plate segment of the first repair plate and offset from the second substantially planar plate segment of the first repair plate by an offset distance; and wherein the first substantially planar plate segment of the first repair plate is positioned flush against a first side of the pole, the second substantially planar plate segment of the first repair plate is positioned flush against a second side of the pole, wherein the second side of the pole is adjacent to the first side of the pole;

placing a second repair plate substantially flush against the pole, wherein the second repair plate is placed adjacent to the first repair plate, such that:

a first substantially planar plate segment of the second repair plate is positioned flush against the second side of the pole;

a second substantially planar plate segment of the second repair plate is positioned flush against a third side of the pole, wherein the third side of the pole is adjacent to the second side of the pole; and an end of the first substantially planar plate segment of the second repair plate is received by a gap formed between the fourth substantially planar plate segment of the first repair plate and the second side of the pole;

affixing the first substantially planar plate segment of the second repair plate to the fourth substantially planar plate segment of the first repair plate;

affixing the first and second substantially planar plate segments of the first repair plate to the first and second sides of the pole, respectively; and affixing the first and second substantially planar plate segments of the second repair plate to the second and third sides of the pole, respectively.

13. The method of claim 12, wherein affixing the first substantially planar plate segment of the second repair plate to the fourth substantially planar plate segment of the first repair plate is achieved by welding.

14. The method of claim 12, wherein affixing the first substantially planar plate segment of the second repair plate to the fourth substantially planar plate segment of the first repair plate is achieved by holes in the fourth substantially planar plate segment of the first repair plate receiving attachment members extending from the first substantially planar plate segment of the second repair plate.

15. The method of claim 12, further comprising placing and affixing a third repair plate to the pole in the same manner as the second repair plate, wherein the third repair plate is positioned adjacent to the second repair plate such that an end of the third repair plate is received by a gap formed by an end of the second repair plate.

16. The method of claim 12, wherein one or more surfaces of the first or second repair plates are placed against a particular portion of the pole, wherein the particular portion of the pole is damaged, corroded, deteriorated, or otherwise desired to be strengthened.

17. The method of claim 12, wherein affixing the first and second substantially planar plate segments of the first repair plate to the first and second sides of the pole is achieved by welding.

18. A pole repair plate having a top edge, a bottom edge, a first side edge and a second side edge, the repair plate comprising:

a first substantially planar plate segment including the first side edge of the repair plate;

a second substantially planar plate segment rotatably connected to the first substantially planar plate segment by a hinge, the first substantially planar plate segment disposed at a first angle from the second substantially planar plate segment, the first angle being adjustable based on the rotation of the hinge;

a third substantially planer plate segment connected to the second substantially planar plate segment at a second angle; and a fourth substantially planar plate segment connected to the third substantially planar plate segment, the fourth substantially planar plate segment including the second side edge of the repair plate, the fourth substantially planar plate segment disposed in a substantially parallel direction to the second planer plate segment and offset from the second substantially planar plate segment by an offset distance, the offset distance being approximately equal to a width of the first substantially planar plate segment.

19. The pole repair plate of claim 18, wherein a surface of the fourth substantially planar plate segment is configured to abut a surface of the first plate segment of the adjacent repair plate.

* * * * *